US006213039B1

(12) United States Patent
Kawahito et al.

(10) Patent No.: US 6,213,039 B1
(45) Date of Patent: Apr. 10, 2001

(54) APPARATUS FOR DETECTING THREAD BREAKAGE IN SEWING MACHINE

(75) Inventors: Toshio Kawahito; Hiroyuki Iuchi; Tatsuaki Kaneda, all of Osaka (JP)

(73) Assignee: Pegasus Sewing Machine Mfg. Co., Ltd., Osaka (JP)

( * ) Notice: Subject to any disclaimer, the term of this patent is extended or adjusted under 35 U.S.C. 154(b) by 0 days.

(21) Appl. No.: 09/604,653

(22) Filed: Jun. 27, 2000

(30) Foreign Application Priority Data

Sep. 7, 1999 (JP) ..... 11-253123

(51) Int. Cl.[7] ..... D05B 69/36
(52) U.S. Cl. ..... 112/273; 112/248
(58) Field of Search ..... 112/273, 278, 112/248, 242, 197, 199

(56) References Cited

U.S. PATENT DOCUMENTS 4,429,651 * 2/1984 Tajima ..... 112/273
4,991,528 * 2/1991 Bellio ..... 112/278

* cited by examiner

*Primary Examiner*—Peter Nerbun
(74) *Attorney, Agent, or Firm*—Jones, Tullar & Cooper, P.C.

(57) ABSTRACT

An apparatus for detecting thread breakage in a sewing machine. The sewing machine comprises a looper reciprocating laterally across a leading end of a needle, a thread-controlling cam fixed on a rotary shaft interlocked with the reciprocal motion of the looper and varying in the extent of projection from the thread take-up stand along with rotation of the shaft, and thread guides disposed on the thread take-up stand at both sides of the thread-controlling cam. Said thread guides have thread eyelets for inserting the looper thread. Other thread guides having thread pass eyelets for inserting the looper thread are fixed and disposed on the looper thread route between the thread-controlling cam and the looper. A thread breakage-detecting member detects presence or absence of vibration of looper thread inserted in the thread pass eyelets of other thread guides between the other thread guides. A control circuit stops the sewing machine from driving on the basis of the detection of absence of thread vibration by this thread breakage-detecting member. In this constitution, breakage of looper thread while the sewing machine is being driven is securely detected, and the sewing machine is stopped immediately when the looper thread is broken, so that lowering of the sewing operation efficiency is effectively prevented.

3 Claims, 3 Drawing Sheets

APPARATUS FOR DETECTING THREAD BREAKAGE IN SEWING MACHINE

BACKGROUND OF THE INVENTION

1. Field of the Invention

The present invention relates to an apparatus for detecting breakage of a looper thread by monitoring vibration generating in looper thread along with driving of a sewing machine when forming a double-chain stitch in a cloth by the sewing machine.

2. Description of the Prior Art

In an ordinary conventional sewing machine comprising a needle moving up and down to penetrate through a needle hole of a needle plate, and a looper reciprocating laterally across the leading end of this needle, for forming a double-chain stitch by collaboration of the needle and looper, usually, a thread-controlling cam varying in the extent of projection from the thread take-up stand according to the rotation of the rotary shaft such as main shaft is disposed between two thread guides having a thread eyelet for inserting the looper thread, and the looper thread slides on the peripheral surface of this thread-controlling cam, so that it is designed to control the thread take-up extent.

In the sewing machine having such constitution, however, if the thread is broken during sewing operation, or if the thread is loose when driving the sewing machine again right after cutting off the thread before sewing operation or after sewing operation, the looper thread may wind around the rotary shaft of the thread-controlling cam. If driving of the sewing machine is continued without noticing the winding of looper thread around the rotary shaft of the thread-controlling cam, the looper thread is drawn out from the supply source side, and the winding amount on the rotary shaft increases progressively, and it takes much time and labor for removing the thread winded around the rotary shaft, which may cause to lower the sewing operation efficiency extremely. In particular, in the narrow tube bed sewing machine for sewing a tubular cloth, since the space in the narrow tube bed is small, it is very difficult to remove the thread winded around the rotary shaft.

SUMMARY OF THE INVENTION

The present invention is devised in the light of such circumstances, and it is hence an object thereof to provide an apparatus for detecting thread breakage in a sewing machine capable of detecting securely breakage of looper thread while driving the sewing machine, stopping driving of the sewing machine promptly, and blocking drop of sewing operation efficiency effectively.

The apparatus for detecting thread breakage in a sewing machine on the present invention is used in a sewing machine (1) comprises a needle (2) moving up and down to penetrate through a needle hole of a needle plate (8), a looper (3) reciprocating laterally across the leading end of the needle (2), a thread take-up stand (10) mounted on a sewing machine bed (l*a*), a thread-controlling cam (11) fixed on a rotary shaft (S) interlocked with the reciprocal motion of the looper (3), and varying in the extent of projection from the thread take-up stand (10) according to rotation of the rotary shaft (S), and a thread guide (12) disposed on the thread take-up stand (10) at both sides of the thread-controlling cam (11) and having a thread eyelet **(12*a*) for inserting the looper thread (6). Said apparatus comprises a pair of thread guides (15), (15) having thread pass eyelets (15*a*) for inserting the looper thread (6) fixed and disposed on the looper thread route between the thread-controlling cam (11) and the looper (3), a thread breakage-detecting member (13) for detecting presence or absence of vibration of looper thread part (6*a*) inserted in the thread pass eyelets (15*a*), (15*a*) of the pair of thread guides (15), (15) between the two thread guides (15) and (15), and a control circuit (17) for stopping driving of the sewing machine (1) on the basis of the detection of absence of thread vibration by this thread breakage-detecting member (13)**.

According to the present invention having such constitution, when the looper thread is consumed at the looper side, the looper thread taken up on the looper thread route through the thread eyelet in the thread guide and the peripheral surface of the thread-controlling cam is inserted into the thread pass eyelets of the pair of thread guides, and is guided into the looper. In the sewing operation by the sewing machine, while the looper thread taken up from the supply source side is normally guided toward the looper, a dynamic vibration is generated in the looper threads inserted into the thread pass eyelets in the pair of thread guides by the thread take-up control by the thread-controlling cam, whereas such vibration is not generated when the thread is broken.

Thus, by monitoring the presence or absence of vibration of looper thread guided into the looper as being inserted into the thread pass eyelets of the pair of thread guides fixed and disposed on the looper thread route between the pair of thread guides, breakage of looper thread can be detected securely without having effects of looper reciprocal motion or change of rotating speed of driving unit for the sewing machine, and driving of the sewing machine can be stopped promptly through the control circuit on the basis of the looper thread breakage-detecting. Therefore, not only the winding of the looper thread on the rotary shaft can be prevented, but also extra labor or time of removing the looper thread winded around the rotary shaft is unnecessary, so that the sewing operation efficiency may be enhanced extremely.

Other objects and effects of the invention will be clarified in the embodiment described below.

PREFERRED EMBODIMENT OF THE INVENTION

Figure 1:
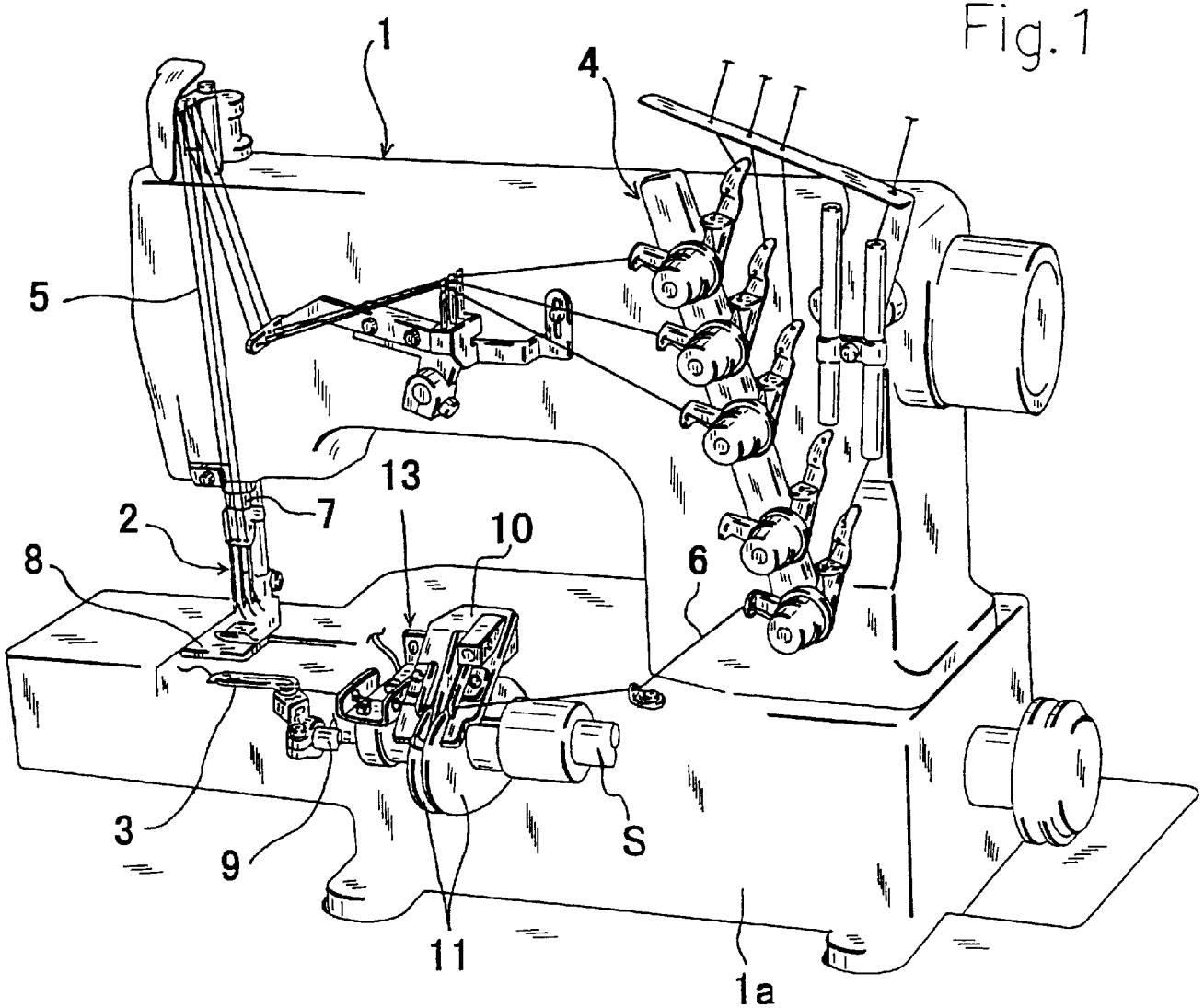
FIG. 1 is a perspective outline view of an entire sewing machine according to the present invention.

An embodiment of the present invention is described below while referring to the drawings.

The sewing machine according to the present invention has three needles 2 and one looper 3 as shown in FIG. 1, and is designed to form a double-chain stitch of stitch type 407 by a needle thread 5 supplied from a thread supply source (not shown) through a thread-tensioning device 4, and a looper thread 6 supplied through the thread-tensioning device 4. The three needles 2 are mounted on a needle bar 7 which moves up and down in cooperation with driving of the sewing machine 1, and penetrate through a needle hole (not shown) of a needle plate 8 mounted on a sewing machine bed l*a*. The looper 3 is mounted on a looper shaft 9 which moves back and forth in cooperation with driving of the sewing machine 1, and reciprocates laterally across the leading end of each needle 2 penetrating through the needle hole of the needle plate 8.

Figure 2:
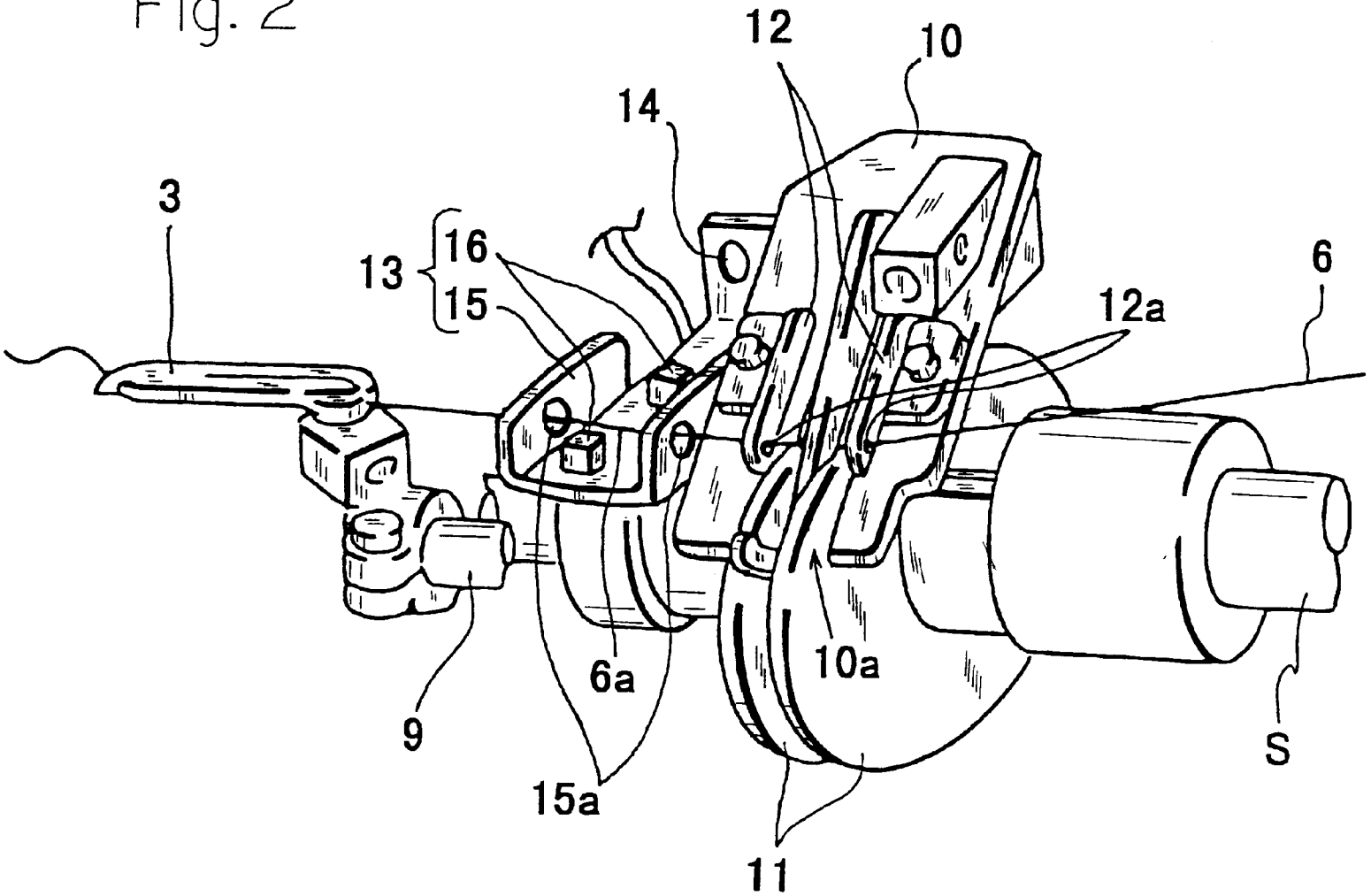
FIG. 2 is a magnified perspective view showing essential parts of the sewing machine.

As shown in FIG. 2, the sewing machine bed la is provided with a thread-controlling cam 11 varying in the extent of projection from a thread take-up stand 10 according to the rotation of a main shaft S (an example of rotary shaft) and thread guides 12 disposed on the thread take-up stand 10 at both sides of the thread-controlling cam 11. The thread take-up stand 10 is fixed on the sewing machine bed 1*a*, so as to be adjustable in position along the rotating direction of the main shaft S. In the thread take-up stand 10, moreover, a slit 10*a* is formed along the rotating direction of the thread-controlling cam 11, and the thread-controlling cam 11 is incorporated and disposed in this slit 10*a*.

The thread guides 12 are disposed oppositely at both sides of the slit 10*a* of the thread take-up stand 10, and thread eyelets 12*a* for inserting the looper thread 6 are formed respectively in these thread guides 12. In this embodiment, the thread-controlling cam 11 is fixed on the main shaft S, but not limited to this, it may be fixed on any shaft rotating in cooperation with reciprocal motion of the looper 3. In the embodiment, the slit for incorporating and disposing the thread-controlling cam 11 is formed in the thread take-up stand 10, but not limited to this, for example, an elongated hole large enough for incorporating and disposing the thread-controlling cam 11 may be formed.

On the looper thread route between the thread-controlling cam 11 and looper 3, a thread breakage-detecting member 13 for detecting thread vibration is disposed. This thread breakage-detecting member 13 is fixed on the sewing machine bed 1*a* by a screw 14. The thread breakage-detecting member 13 comprises other thread guides 15, 15 having thread pass eyelets 15*a*, 15*a*, and an optical sensor 16 consisted of a light emitting device 16A and a photo detecting device 16B disposed oppositely in the direction crossing with the disposing direction of the thread pass eyelets 15*a*, 15*a*of other thread guides 15, 15. Therefore, the vibration of the looper thread part 6a inserted into the thread pass eyelets 15*a*, 15*a*of other thread guides 15, 15 is detected between other thread guides 15, 15. In the embodiment, the thread breakage-detecting member 13 is fixed on the sewing machine bed 1*a*, but not limited to this, it may be fixed, for example, on the thread take-up stand 10.

Figure 3:
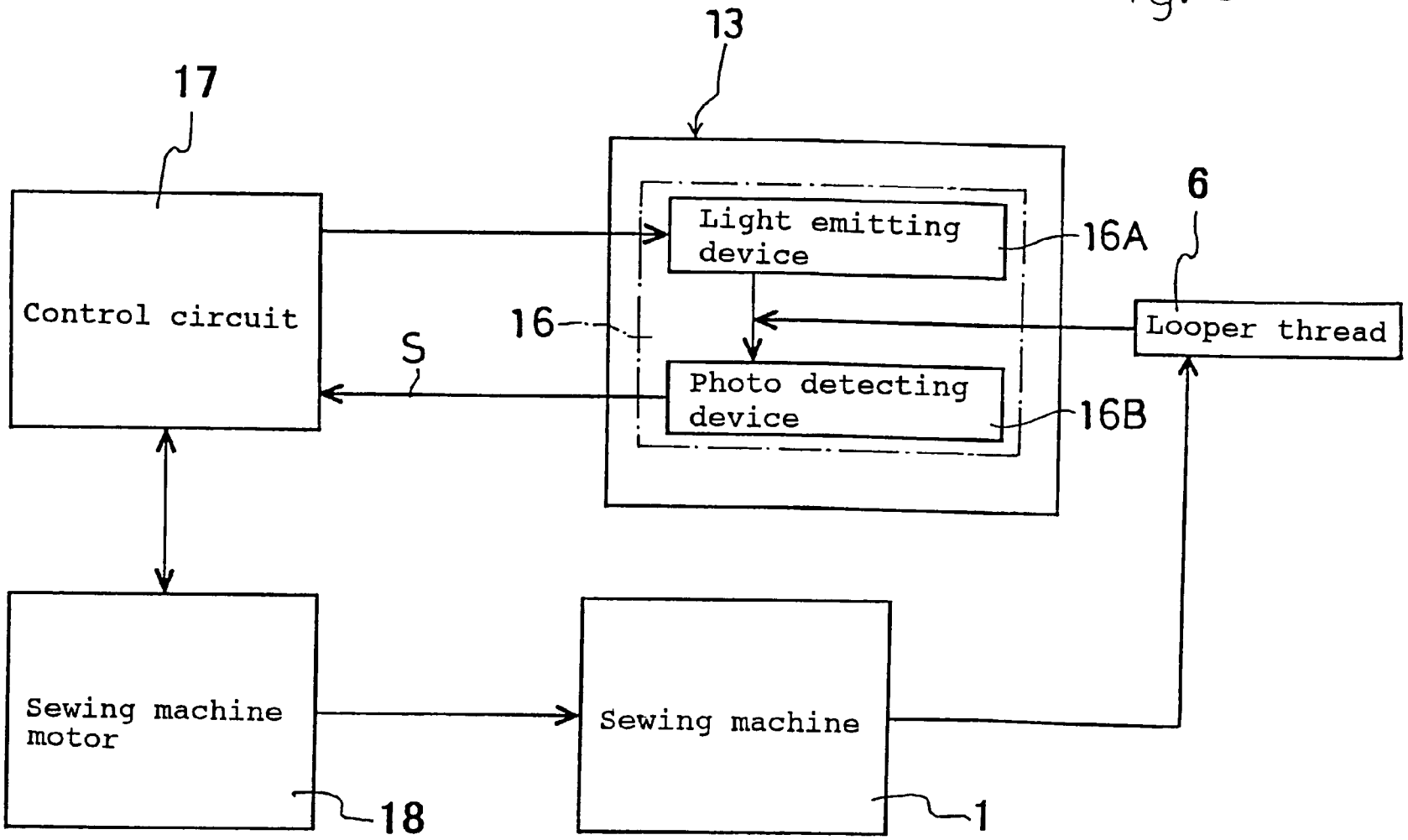
FIG. 3 is a block diagram showing a constitution of a control system of the sewing machine.

FIG. 3 is a block diagram showing a constitution of a control system of the sewing machine 1 according to the present invention. This control system has a control circuit 17 which receives a detection signal Sn of presence or absence of vibration of the looper thread 6 by the thread breakage-detecting member 13 including the optical sensor 16 and controls a basic operation program of a sewing machine motor 18. This control circuit 17 is designed to stop driving of the swing machine 1 through the sewing machine motor 18 on the basis of detection of absence of thread vibration from the optical sensor 16.

The operation of the sewing machine provided with said thread breakage-detecting member 13 is explained below. When sewing a cloth by the sewing machine 1, the thread is consumed at the looper 3 side, and the looper thread 6 is taken up on the looper thread route by way of the thread eyelets 12*a* of the thread guides 12 and the peripheral surface of the thread-controlling cam 11. While the looper thread 6 is being normally guided in the looper 3 through the thread pass eyelets 15*a*, 15*a*of other thread guides 15, 15, the dynamic thread vibration generated in the looper thread part 6*a* between the thread pass eyelets 15*a*, 15*a*is detected by the thread breakage-detecting member 13, and driving of the sewing machine motor 18 is maintained through the control circuit 17 on the basis of the detection signal Sn.

On the other hand, if the looper thread 6 is broken during sewing operation, thread vibration is not generated in the looper thread part 6*a* inserted in the thread pass eyelets 15*a*, 15*a*of other thread guides 15, 15 fixed and disposed on the looper thread route. At this time, detection signal Sn of absence of thread vibration from the optical sensor 16 monitoring the looper thread part 6*a*between other thread guides 15, 15 is input to the control circuit 17, and driving of the sewing machine 1 is stopped through the sewing machine motor 18 according to this signal Sn. As a result, not only winding of the broken looper thread 6 on the main shaft S is prevented, but also extra time and labor for removing the looper thread 6 winded on the main shaft S can be saved, so that lowering of sewing operation efficiency can be effectively blocked.

The entire disclosure of Japanese Patent Application No. 11-253123 filed on Sep. 7, 1999, including the specification, claims, drawings and summary are incorporated herein by reference to its entirety.

What is claimed is:

1. An apparatus for detecting thread breakage in a sewing machine which is provided with needles moving up and down to penetrate through a needle hole of a needle plate, a looper reciprocating laterally across the leading end of the needle, a thread take-up stand mounted on a sewing machine bed, a thread-controlling cam fixed on a rotary shaft interlocked with the reciprocal motion of the looper and changing in the extent of projection from the thread take-up stand according to rotation of the rotary shaft, and thread guides disposed on the thread take-up stand at both sides of the thread-controlling cam and having thread eyelets for inserting the looper thread, comprising:

other thread guides having thread pass eyelets for inserting the looper thread fixed and disposed on the looper thread route between the thread-controlling cam and the looper, a thread breakage-detecting member for detecting presence or absence of vibration of looper thread inserted in the thread pass eyelets of other thread guides between the two thread guides, and a control circuit for stopping driving of the sewing machine on the basis of the detection of absence of thread vibration by this thread breakage-detecting member.

2. An apparatus for detecting thread breakage in a sewing machine as in claim 1 wherein, said thread breakage-detecting member comprises an optical sensor having a light emitting device and a photo detecting device disposed oppositely in the direction crossing with the disposing direction of thread pass eyelets of other thread guides.

3. An apparatus for detecting thread breakage in a sewing machine as defined in claim 1 wherein the thread take-up stand is mounted the sewing machine bed so as to be adjustable in position along the rotating direction of the rotary shaft, and a slit is formed in said thread take-up stand along the rotating direction of the thread-controlling cam, and the thread-controlling cam is disposed in said slit.

* * * * *